US010077161B2

(12) United States Patent
Hayashi

(10) Patent No.: US 10,077,161 B2
(45) Date of Patent: Sep. 18, 2018

(54) MEDIUM FEEDING CONTROL METHOD AND MEDIUM FEEDING APPARATUS

(71) Applicant: SEIKO EPSON CORPORATION, Tokyo (JP)

(72) Inventor: Toru Hayashi, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 674 days.

(21) Appl. No.: 14/711,311

(22) Filed: May 13, 2015

(65) Prior Publication Data

US 2015/0329310 A1 Nov. 19, 2015

(30) Foreign Application Priority Data

May 16, 2014 (JP) ..... 2014-102059
Mar. 26, 2015 (JP) ..... 2015-063900

(51) Int. Cl.

| | |
|---|---|
| ***B65H 59/38*** | (2006.01) |
| ***B65H 23/192*** | (2006.01) |
| ***B65H 23/182*** | (2006.01) |
| ***B65H 23/185*** | (2006.01) |
| ***B65H 23/188*** | (2006.01) |

(Continued)

(52) U.S. Cl.

CPC ..... *B65H 23/192* (2013.01); *B41J 11/42* (2013.01); *B41J 15/165* (2013.01); *B65H 23/185* (2013.01); *B65H 23/1825* (2013.01); *B65H 23/1888* (2013.01); *B65H 59/388* (2013.01); *B65H 2404/143* (2013.01); *B65H 2513/11* (2013.01); *B65H 2515/31* (2013.01); *B65H 2553/51* (2013.01); *B65H 2557/2426* (2013.01); *B65H 2557/2644* (2013.01); *B65H 2701/174* (2013.01); *B65H 2801/12* (2013.01)

(58) Field of Classification Search

CPC ..... B65H 23/192; B65H 23/1888; B65H 23/185; B65H 23/1825; B65H 59/388; B65H 2553/51; B65H 2801/12; B65H 2701/174; B65H 2404/143; B65H 2513/11; B65H 2557/2644; B65H 2515/31; B65H 2557/2426; B41J 11/42; B41J 15/165

See application file for complete search history.

(56) References Cited

U.S. PATENT DOCUMENTS 3,762,663 A * 10/1973 Nedreski ..... B65H 23/18 242/412.3
6,314,333 B1 * 11/2001 Rajala ..... B65H 23/048 226/44

(Continued)

FOREIGN PATENT DOCUMENTS

| | | |
|---|---|---|
| JP | 08-085659 | 4/1996 |
| JP | 2009-256095 | 11/2009 |
| JP | 2013-129520 | 7/2013 |

*Primary Examiner* — William A. Rivera
(74) *Attorney, Agent, or Firm* — Workman Nydegger

(57) ABSTRACT

A medium feeding apparatus includes a detection tension acquiring unit that acquires a detection tension which is a tension applied during an (n−1)-th feeding operation in a plurality of feeding operations in which the medium is fed, a corrected tension calculating unit that calculates a corrected tension obtained by correcting a target tension which is a target value of a tension to be applied during a n-th feeding operation based on the detection tension, and a driving controlling unit that controls a roll motor during the n-th feeding operation based on the corrected tension.

6 Claims, 6 Drawing Sheets

(51) Int. Cl.
*B41J 11/42* (2006.01)
*B41J 15/16* (2006.01)

(56) References Cited

U.S. PATENT DOCUMENTS

| | | | | |
|---|---|---|---|---|
| 7,780,111 | B2 * | 8/2010 | Elbel | B65H 5/28 242/412.3 |
| 8,159,159 | B2 | 4/2012 | Fernandez et al. | |
| 8,167,228 | B2 * | 5/2012 | Kobayashi | B41J 15/04 242/418 |
| 9,545,803 | B2 * | 1/2017 | Horaguchi | B41J 15/16 |
| 2007/0166016 | A1 * | 7/2007 | Iesaki | B41J 11/42 388/801 |
| 2009/0016797 | A1 * | 1/2009 | Brugue | B41J 15/16 400/613 |
| 2009/0121423 | A1 * | 5/2009 | Nakamura | B65H 16/028 271/275 |
| 2010/0327515 | A1 * | 12/2010 | Nakada | B65H 16/10 271/225 |
| 2014/0152733 | A1 * | 6/2014 | Sano | H02P 7/29 347/16 |

* cited by examiner

MEDIUM FEEDING CONTROL METHOD AND MEDIUM FEEDING APPARATUS

BACKGROUND

1. Technical Field

The present invention relates to a medium feeding control method of a medium feeding apparatus which feeds a medium from a roll body around which the medium is wound and the medium feeding apparatus.

2. Related Art

In the related art, for a printer which includes rotatable holders that hold a roll body around which a medium is wound, a transportation driving roller that pulls and feeds the medium from the roll body, a roll motor that rotates the roll body via the rotatable holders so that the medium is fed from the roll body, and a PF motor that drives the transportation driving roller, a medium feeding control method controlling the roll motor so that tension applied to the medium between the roll body and the transportation driving roller becomes equal to or lower than a predetermined value is known. In such a medium feeding control method, in a state in which the medium is loosened, a roll load which is a load needed to rotate the roll body when the roll body is rotated at an arbitrary speed is obtained by respectively measuring loads of the roll motor when being driven so as to rotate the roll body at low speed and high speed (refer to JP-A-2009-256095).

However, in such a printer, the roll load may not be stable during feeding the medium, and for example, changes during feeding the medium in a case in which the roll body is eccentric. Changing of the roll load causes changing of the tension which is applied to the medium between the roll body and the transportation driving roller in every feeding operation.

SUMMARY

An advantage of some aspects of the invention is to provide a medium feeding control method which can suppress changing of tension applied to a medium between a roll body and a feeding roller in every feeding operation, and a medium feeding apparatus.

According to an aspect of the invention, there is a medium feeding control method of a medium feeding apparatus which includes a holding unit that holds a roll body around which a medium is wound, a feeding unit that pulls and feeds the medium from the roll body, and a rotation driving unit that rotates the roll body through the holding unit in a direction in which the medium is fed from the roll body, and a feeding driving unit that drives the feeding unit, and performs a feeding operation multiple times in which the medium is fed. The method includes acquiring a detection tension corresponding to a tension applied to the medium between the roll body and the feeding unit during an (n−1)-th or earlier feeding operation (n is an integer equal to or greater than 2) in a plurality of the feeding operations; calculating a corrected tension by correcting a target tension which is a target value of a tension to be applied during an n-th feeding operation on the basis of the detection tension; and controlling the feeding driving unit during the n-th feeding operation based on the corrected tension.

According to another aspect of the invention, there is provided a medium feeding apparatus including: a holding unit that holds a roll body around which a medium is wound; a feeding unit that pulls and feeds the medium from the roll body; a rotation driving unit that rotates the roll body through the holding unit so that the medium is fed from the roll body; a feeding driving unit that drives the feeding unit; a detection tension acquiring unit that acquires a detection tension which is a tension applied to the medium between the roll body and the feeding unit during an (n−1)-th or earlier feeding operation (n is an integer equal to or greater than 2) in a plurality of feeding operations in which the medium is fed; a corrected tension calculating unit that calculates a corrected tension obtained by correcting a target tension which is a target value of a tension to be applied during the n-th feeding operation based on the detection tension; and a driving controlling unit that controls the feeding driving unit during the n-th feeding operation based on the corrected tension.

According to the aspects, by feeding back the detection tension during the (n−1)-th or earlier feeding operation, the target tension in the n-th feeding operation is corrected and then the corrected tension is calculated, and the rotation driving unit is controlled during the n-th feeding operation based on the calculated corrected tension. For this reason, during the n-th feeding operation, an error of in actual tension with respect to the target tension can be reduced. As a result, changing of the tension applied to the medium between the roll body and the feeding roller in every feeding operation can be suppressed.

In the medium feeding control method, it is preferable that when acquiring the detection tension, a feeding current flowing in the feeding driving unit during the (n−1)-th or earlier feeding operation and a reference current flowing in the feeding driving unit in a state in which the medium between the roll body and the feeding driving unit is loosened at the time of performing a reference current measuring operation for measuring the reference current that drives the feeding driving unit are acquired, a tension current which is a difference between the feeding current and the reference current is calculated, and the detection tension is calculated based on the tension current.

In this case, the detection tension can be calculated by acquiring the feeding current and the reference current flowing in the feeding driving unit.

In the medium feeding control method, it is preferable that the feeding current is acquired multiple times at a predetermined interval in one feeding operation when acquiring the feeding current, the reference current is acquired multiple times at the predetermined interval in one reference current measuring operation when acquiring the reference current, a plurality of the tension currents is acquired from the feeding currents acquired at the predetermined interval and the reference currents acquired at the predetermined interval when calculating the tension current, respectively, and the detection current is acquired on the basis of an average tension current which is an average value of the plurality of tension currents when acquiring the detection tension.

In the medium feeding control method, it is preferable that the feeding current is acquired multiple times at a predetermined interval in one feeding operation when acquiring the feeding current, the reference current is acquired multiple times at the predetermined interval in one reference current measuring operation when acquiring the reference current, a plurality of the tension currents is acquired from the feeding currents acquired at the predetermined interval and the reference currents acquired at the predetermined interval when calculating the tension current, respectively, and the detection current is acquired on the basis of a peak tension current which is a maximum value in the plurality of tension currents when acquiring the detection tension.

In this case, even when the tension current changes complexly during one feeding operation, the detection tension correlated with the feeding amount can be calculated.

In the medium feeding control method, it is preferable that the detection tension corresponding to the tension applied to the medium during the (n−1)-th feeding operation is acquired, when acquiring the detection tension.

In this case, in each feeding operation, an error in an actual tension with respect to the target tension can be reduced by correcting the target tension based on the detection tension during a previous feeding operation.

In the medium feeding control method, it is preferable that when calculating the corrected tension, a tension error integral value obtained by integrating the tension errors which are errors in the detection tensions with respect to the target tension is calculated, a tension correction amount is calculated on the basis of the tension error integral value, and the corrected tension is calculated by adding the tension correction amount to the target tension.

In this case, by calculating the tension correction amount using the tension error integral value, the actual tension can be gradually approximated to the target tension. For this reason, even when the detection tension includes the detection error, calculating a tension correction amount with an amplified the detected error can be suppressed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a medium feeding control method and a recording apparatus according to an embodiment of the invention will be described with reference to attached drawings.

Figure 1:
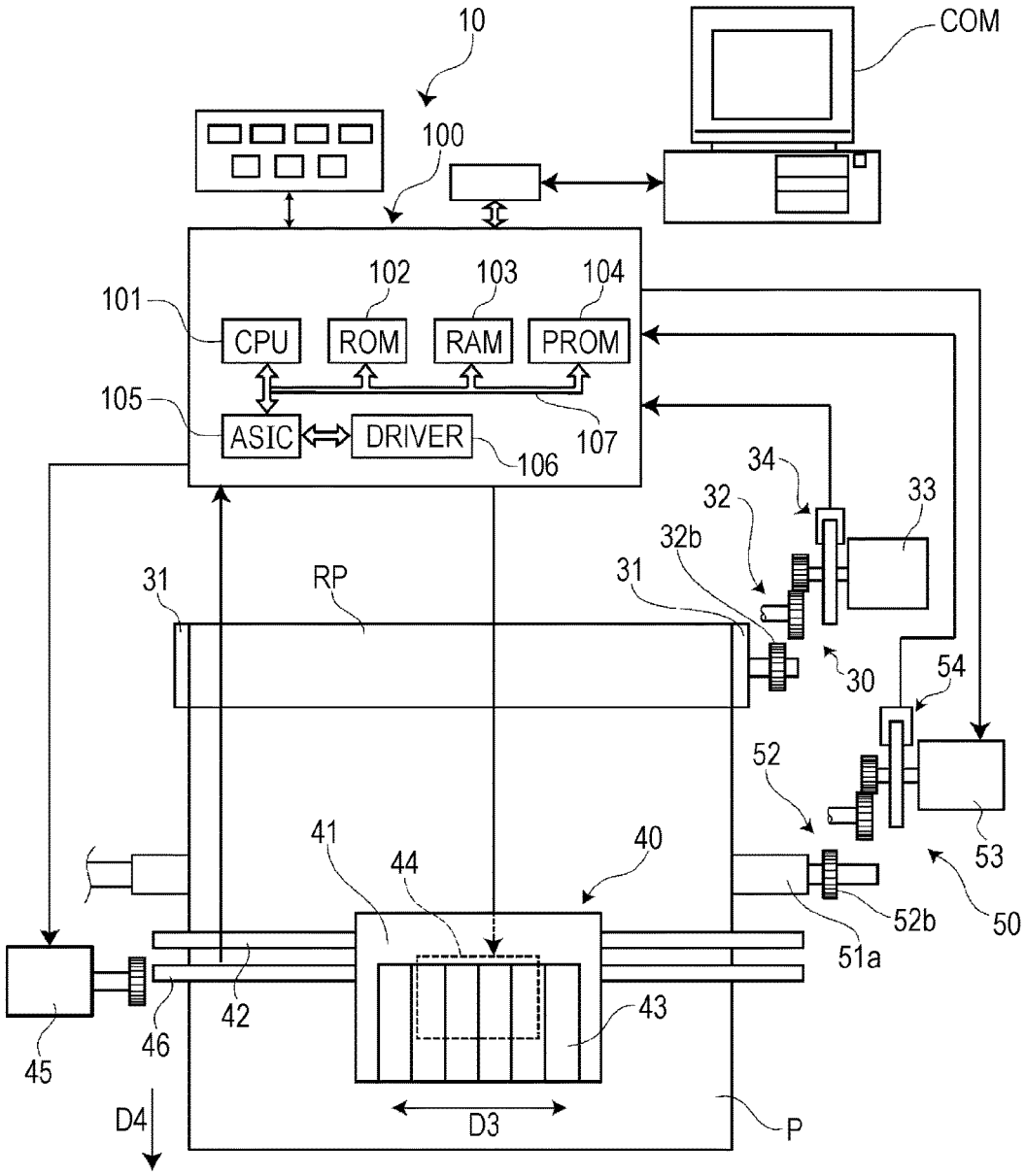
FIG. 1 is a view illustrating a schematic configuration of a recording apparatus according to an embodiment of the invention.
Figure 2:
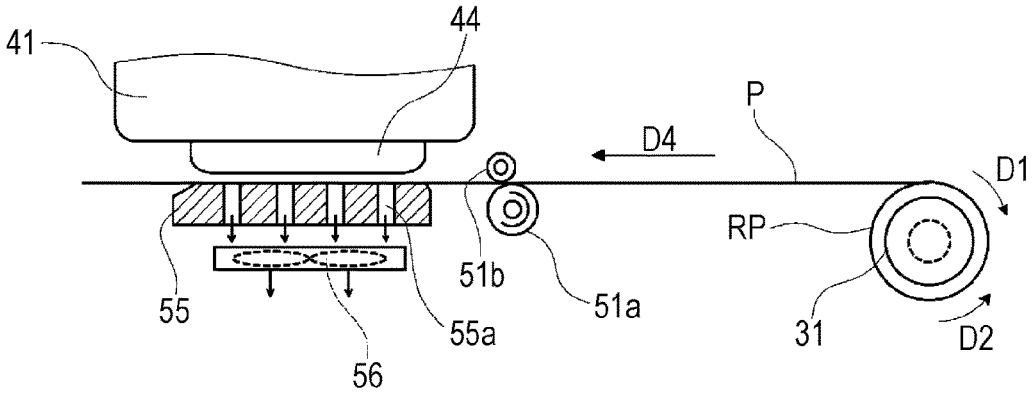
FIG. 2 is a view illustrating a positional relationship between a roll body, a driving roller, a driven roller, and a recording head.

As illustrated in FIG. 1 and FIG. 2, in a recording apparatus 10 of the embodiment, a medium P is pulled and fed from a roll body RP, and an image is printed on the medium P in an ink jet manner. In addition, the roll body RP set in the recording apparatus 10 is prepared by winding a band shape medium P around a cylindrical core (not illustrated) in a roll shape. Moreover, a material of the medium P is not particularly limited, and for example, may be recording paper, film, and fabric. A width of the medium P is, for example, 64 inches. A maximum weight of the roll body RP which is capable of being set in the recording apparatus 10 is, for example, 80 kg.

In addition, the recording apparatus 10 is communicatively connected to a computer COM which is an external apparatus. The recording apparatus 10, for example, receives image data for recording the image from the computer COM. Moreover, the recording apparatus 10 is not limited to receiving the image data from the computer COM, and for example, may receive the image data from a recording medium such as a USB (Universal Serial Bus) memory, or the recording apparatus 10 itself may write the image data.

The recording apparatus 10 includes a roll driving mechanism 30, a carriage driving mechanism 40, a medium feeding mechanism 50, a platen 55, and a controller 100.

The roll driving mechanism 30 rotates the roll body RP around which the medium P is wound. The roll driving mechanism 30 includes a pair of rotatable holders 31, a roll wheel train 32, a roll motor 33, and a roll rotation detecting unit 34.

Moreover, the rotatable holder 31 is an example of a "holding unit", and the roll motor 33 is an example of a "rotation driving unit".

The rotatable holders 31 forming a pair are respectively inserted into both ends of the core of the roll body RP, and holds the roll body RP from both sides. The rotatable holders 31 forming a pair is respectively supported to be capable of being rotated by a holder supporting portion (not illustrated). One of the rotatable holders 31 is provided with a roll input gear 32*b* which is engaged with a roll output gear (not illustrated) of the roll wheel train 32.

The roll motor 33 applies driving force to the one rotatable holder 31. The roll motor 33 is, for example, a DC (Direct Current) motor. The rotatable holder 31 and the roll body RP which is held by the rotatable holder 31 are rotated by receiving the driving force transmitted from the roll motor 33 through the roll wheel train 32. More specifically, the roll motor 33 can rotate the roll body RP in a rewinding direction D1 so that the medium P pulled from the roll body RP is rewound around the roll body RP. In addition, the roll motor 33 can rotate the roll body RP in a feeding rotation direction D2 so that the medium P is fed from the roll body RP. The roll motor 33 rotates the roll body RP in the rewinding direction D1, for example, when positioning a front edge of the medium P. Meanwhile, the roll motor 33 rotates the roll body RP in the feeding rotation direction D2 when performing a feeding operation to be described later.

The roll rotation detecting unit 34 detects a rotation position and a rotation direction of the roll body RP. The roll rotation detecting unit 34 is a rotary encoder including a disk-shaped scale which is installed to an output shaft of the roll motor 33 and a photointerrupter.

The carriage driving mechanism 40 records the image on the medium P which is pulled from the roll body RP. The carriage driving mechanism 40 includes a carriage 41, a carriage shaft 42, a recording head 44, a carriage motor 45, and a carriage position detecting unit 46.

The carriage motor 45 drives a belt mechanism (not illustrated) such that the carriage 41 is moved in a moving direction D3 along the carriage shaft 42. In the carriage 41, an ink tank 43 in which each of inks having various colors is stored is installed. To the ink tank 43, the ink is supplied from an ink cartridge (not illustrated) through a tube. In addition, on a bottom surface of the carriage 41, the recording head 44 which is an ink jet head is installed. The recording head 44 discharges the ink which is supplied from the ink tank 43 from a nozzle.

The carriage position detecting unit 46 detects a position of the carriage 41 in the moving direction D3. The carriage position detecting unit 46 is a linear encoder which includes a linear scale installed along the moving direction D3 and a photointerrupter.

The medium feeding mechanism 50 feeds the medium P pulled from the roll body RP in a feeding direction D4 which is substantially orthogonal to the moving direction D3. The medium feeding mechanism 50 includes a driving roller 51*a*, a driven roller 51*b*, a feeding wheel train 52, a feeding motor 53, and a feeding rotation detecting unit 54.

Moreover, the driving roller 51*a* is an example of a "feeding unit". The feeding motor 53 is an example of a "feeding driving unit".

The driving roller 51*a* and the driven roller 51*b* rotationally feed the medium P which is pinched therebetween. The driving roller 51*a* is provided with a feeding input gear 52*b* which is engaged with a feeding output gear (not illustrated) of the feeding wheel train 52.

The feeding motor 53 applies a driving force to the driving roller 51*a*. The feeding motor 53 is, for example, a DC motor. The driving roller 51*a* is rotated by transmitting the driving force from the feeding motor 53 to the driving roller 51*a* through the feeding wheel train 52, and thus, the driven roller 51*b* is rotated.

The feeding rotation detecting unit 54 detects a rotation position and a rotation direction of the driving roller 51*a*. The feeding rotation detecting unit 54 is a rotary encoder including a disk-shaped scale which is installed to an output shaft of the feeding motor 53 and a photo interrupter.

A platen 55 is installed so as to face the recording head 44. In the platen 55, a plurality of suction holes 55*a* which vertically penetrates the platen 55 is formed. In addition, below the platen 55, a suction fan 56 is installed. When the suction fan 56 is operated, the inside of the suction hole 55*a* have a negative pressure, and then the medium P on the platen 55 is sucked and held thereon. The ink is discharged from the recording head 44 to the medium P which is sucked and held on the platen 55.

The controller 100 controls all of units in the recording apparatus 10. The controller 100 includes a CPU (Central Processing Unit) 101, a ROM (Read Only Memory) 102, a RAM (Random Access Memory) 103, a PROM (Programmable ROM) 104, an ASIC (Application Specific Integrated Circuit) 105, a motor driver 106, and a bus 107. In addition, pulse signals from the roll rotation detecting unit 34, the carriage position detecting unit 46, and the feeding rotation detecting unit 54 are input to the controller 100. A functional configuration of the controller 100 will be described later.

The motor driver 106 is an example of a "driving controlling unit".

In the recording apparatus 10 as described above, when a recording job in which the image is recorded on the medium P is performed, a dot forming operation and the feeding operation are repeatedly performed. In other words, the recording apparatus 10 repeatedly and intermittently performs the feeding operation multiple times in one recording job. Here, the dot forming operation is a dot forming operation in which dots are formed on the medium P by discharging the ink from the recording head 44 while moving the carriage 41 in the moving direction D3, and this is called a main scanning. The feeding operation is a feeding operation in which the medium P is fed in the feeding direction D4, and this is called a sub scanning. Moreover, a rotation amount when the roll body RP is rotated in one feeding operation is typically less than one rotation and the rotation amount depends on the diameter of the roll body RP at the time of rotation.

Figure 3:
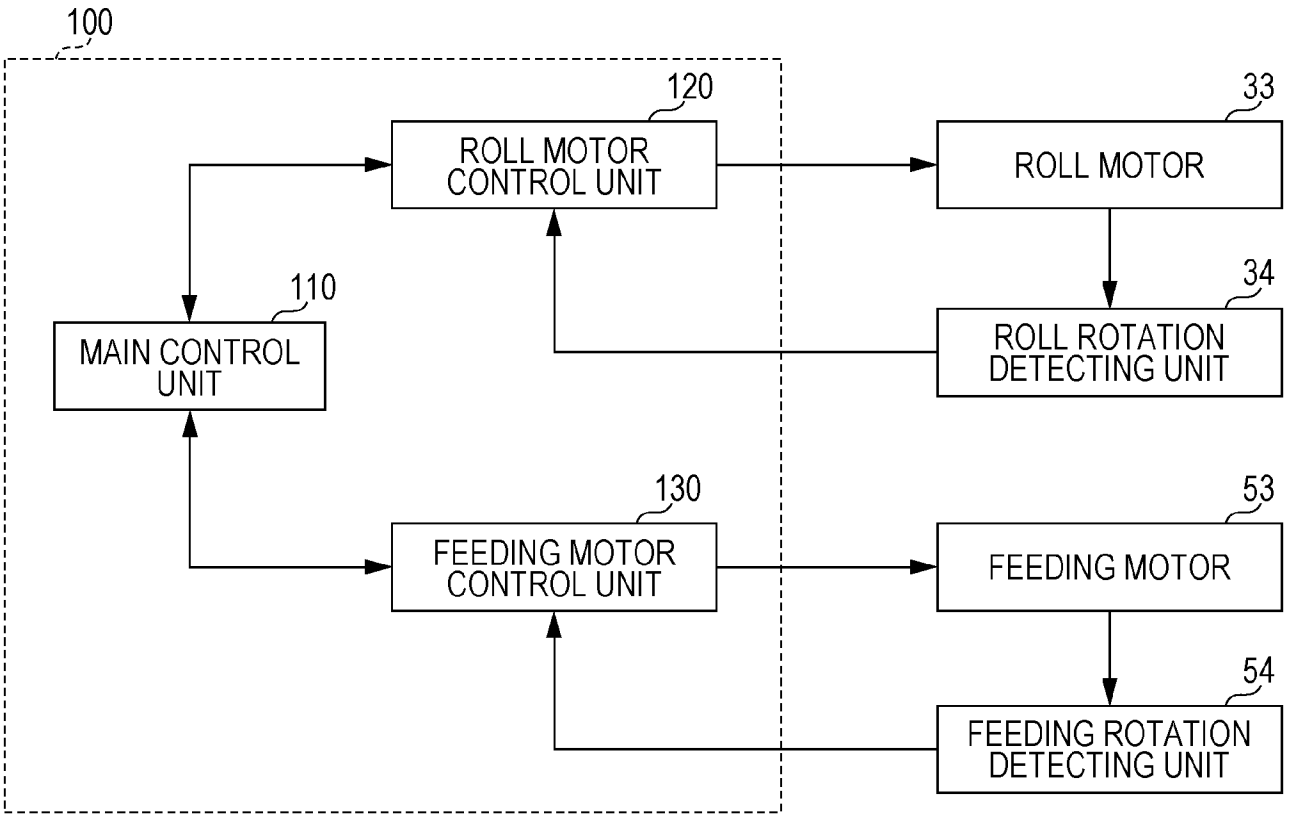
FIG. 3 is a block diagram illustrating a functional configuration example of a controller.

With reference to FIG. 3, a functional configuration example of the controller 100 will be described. The controller 100 includes a main control unit 110, a roll motor control unit 120, and a feeding motor control unit 130. Each of these functional units is realized by a cooperation of hardware constituting the controller 100 and software stored in a memory such as the ROM 102.

The main control unit 110 gives instructions to the roll motor control unit 120 and the feeding motor control unit 130. The main control unit 110 can give the instructions to the roll motor control unit 120 and the feeding motor control unit 130, such that the roll motor 33 and the feeding motor 53 are independently driven, or the roll motor 33 and the feeding motor 53 are synchronously driven.

Figure 4:
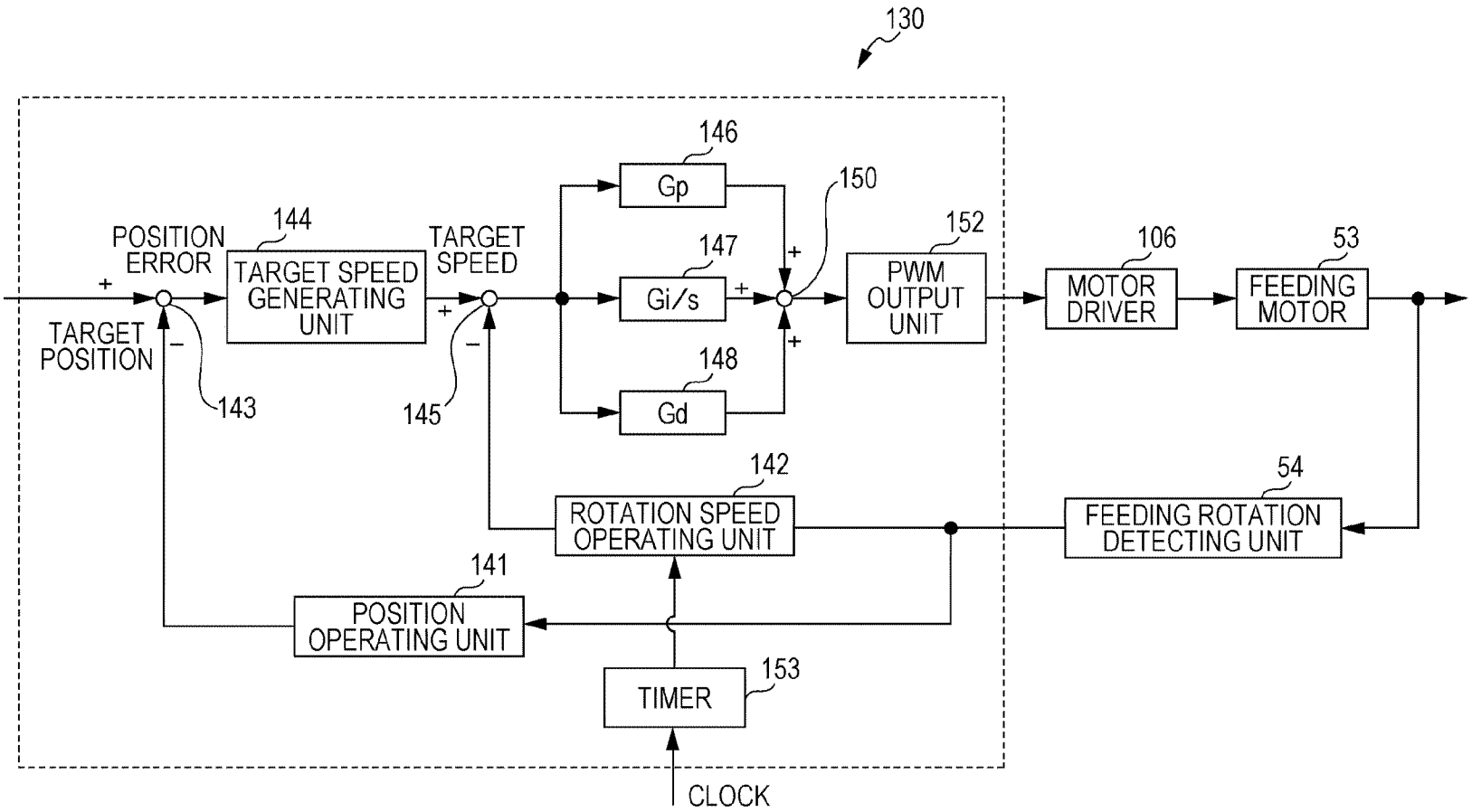
FIG. 4 is a block diagram illustrating a functional configuration example of a feeding motor control unit.

FIG. 4 is a block diagram illustrating the feeding motor control unit 130 at a time of realizing PID controlling. The feeding motor control unit 130 includes a position calculating unit 141, a rotational speed calculating unit 142, a first subtracting unit 143, a target speed generating unit 144, a second subtracting unit 145, a proportion element 146, an integral element 147, a differential element 148, a PID adding unit 150, a PWM (Pulse Width Modulation) output unit 152, and a timer 153.

The position calculating unit 141 time-serially calculates rotation positions of the driving roller 51*a* by counting pulse signals from the feeding rotation detecting unit 54. The rotational speed calculating unit 142 calculates a rotational speed of the driving roller 51*a* based on the pulse signals from the feeding rotation detecting unit 54 and a time measured by the timer 153.

The first subtracting unit 143 calculates a position error between the rotation position of the driving roller 51*a* output from the position calculating unit 141 and a target position instructed by the main control unit 110. The target speed generating unit 144 calculates a target speed corresponding to a predetermined speed table based on the position error output from the first subtracting unit 143. The second subtracting unit 145 calculates a speed error ΔV between the rotational speed of the driving roller 51*a* output from the rotational speed calculating unit 142 and the target speed output from the target speed generating unit 144.

The speed error ΔV output from the second subtracting unit 145 is input to the proportion element 146, the integral element 147, and the differential element 148. Each element calculates a control value Q to be described below by Equations (1) to (3) based on the speed error ΔV.

$$QP(j)=\Delta V(j)\times Kp \tag{1}$$

$$QI(j)=Q(j-1)+\Delta V(j)\times Ki \tag{2}$$

$$QD(j)=\{\Delta V(j)-\Delta V(j-1)\}\times Kd \tag{3}$$

Here, j indicates a time, Kp indicates a proportion gain, Ki indicates an integral gain, and Kd indicates a differential gain.

The PID adding unit 150 sums each of the control values output from the proportion element 146, the integral element 147, and the differential element 148, and outputs the total control value Qpid to a PWM output unit 152. The PWM output unit 152 outputs a PWM signal of a duty value corresponding to the control value Qpid to the motor driver 106. The motor driver 106 drives the feeding motor 53 by PWM controlling based on the PWM signal output from the PWM output unit 152.

In the embodiment, the feeding motor control unit 130 is configured to PID-control the feeding motor 53; however, a configuration of the feeding motor control unit 130 is not limited thereto, and for example, the feeding motor control unit 130 may be configured to PI-control the feeding motor 53.

The recording apparatus 10 not only controls driving of the feeding motor 53, but also controls driving of the roll motor 33 at the time of the feeding operation. Hereinafter, controlling of driving the roll motor 33 will be described.

Figure 5:
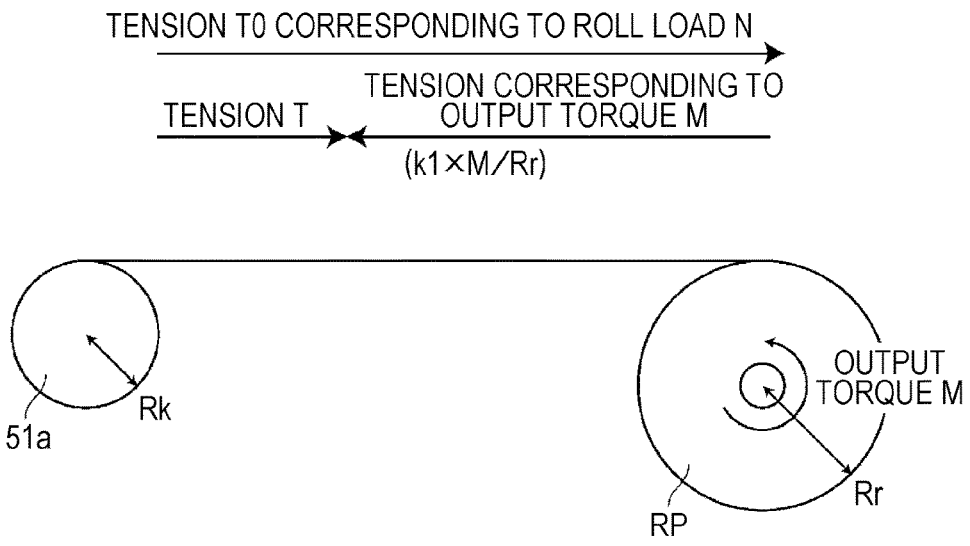
FIG. 5 is a view schematically describing a concept of tension T.

With reference to FIG. 5, first, a case is described in which the medium P is fed with the recording apparatus 10 not driving the roll motor 33 and only driving the feeding motor 53 at the time of the feeding operation. In this case, the medium P is pulled so that the roll body RP is passively rotated in the feeding rotation direction D2. Accordingly, the roll load N which is a load needed to rotate the roll body RP is generated in the periphery of the rotation shaft of the roll body RP. At this time, a tension T0 which is applied to the medium P between the roll body RP and the driving roller 51*a* can be expressed by Equation (4) due to a balance of a moment at the periphery of the rotation shaft of the roll body RP.

$$T0=k1\times N/Rr \tag{4}$$

k1: proportion constant.

Rr: radius of roll body RP.

Next, a case in which the medium P is fed with the recording apparatus 10 driving both the feeding motor 53 and the roll motor 33 at the time of the feeding operation, that is, a state which is the same as an actual feeding operation will be described. In a case in which the roll motor 33 generates an output torque M so that the roll body RP is rotated in the feeding rotation direction D2, a torque in which the output torque M is subtracted from the roll load N is applied to the periphery of the rotation shaft of the roll body RP. In this case, the tension T can be expressed by Equation (5).

$$T=k1\times(N-M)/Rr \tag{5}$$

Based on Equation (5), the output torque M of the roll motor 33 can be expressed by Equation (6).

$$M=N-\{(Rr/k1)\times T\} \tag{6}$$

Here, the proportion constant k1 is known. The radius Rr of the roll body RP can be calculated, for example, according to a count value of the roll rotation detecting unit 34 and a count value of the feeding rotation detecting unit 54 when the medium P is fed by driving the feeding motor 53 alone. Further, it is known that the roll load N has a linear correspondence relationship between with the rotational speed V of the roll body RP. For this reason, by performing a load measuring operation to be described later at the time of mounting the roll body RP, the roll load N corresponding to an arbitrary rotational speed V can be obtained. Accordingly, when a target tension Ta which is a target value of the tension T is substituted for T in Equation (6), the output torque M of the roll motor 33 can be calculated. Here, the target tension Ta is set so that the medium P is not skewed or torn and maintains good condition at the time of feeding the medium P. The target tension Ta is preferably calculated by an experiment in advance, and is set to be an appropriate value according to properties of the medium P. In addition, the set target tension Ta is stored with information relating to the medium P in the ROM 102, or the like. Moreover, the target tension Ta may be arbitrarily set by a user and be input to the recording apparatus 10 directly or through the computer COM. In addition, based on the stored target tension Ta, the target tension changed by changing of the diameter of the roll body RP or changing of a state of the recording apparatus 10 may be used.

Figure 6:
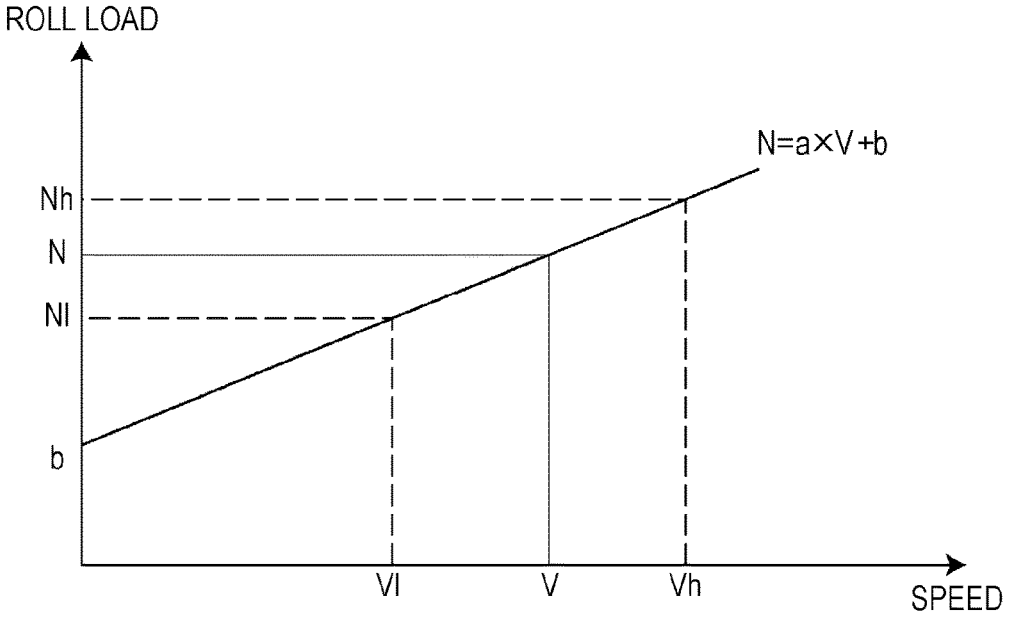
FIG. 6 is a graph illustrating a relationship between an arbitrary rotational speed V of the roll body and a roll load N needed to rotate the roll body.

With reference to FIG. 6, the load measuring operation will be described. It is known that the roll load N has the linear correspondence relation with the rotational speed V of the roll body RP. For this reason, if the roll load Nl corresponding to a low rotational speed Vl and the roll load Nh corresponding to a high rotational speed Vh are known, a gradient a and a segment b in an approximation curve (N=a×V+b) are determined, and the roll load N corresponding to the arbitrary rotational speed V can be calculated by a linear interpolation.

First, the controller 100 drives the roll motor 33 so that the roll body RP is rotated in the feeding rotation direction D2 at the low rotational speed Vl. At this time, the roll motor control unit 120 of the controller 100 has the same configuration as that of the feeding motor control unit 130 illustrated in FIG. 4 so as to drive the roll motor 33 by PID-controlling. The controller 100 acquires the duty value output to the roll motor 33 as the roll load Nl at a time point when the rotational speed of the roll body RP is stable at the rotational speed Vl. The roll load Nl indicates a torque which is needed to rotate the roll body RP at the rotational speed Vl. Moreover, the controller 100 can acquire the duty value based on the control value Ql of the integral element 147 at the time point when the rotational speed of the roll body RP is stable.

Next, the controller 100 drives the roll motor 33 so that the roll body RP is rotated in the feeding rotation direction D2 at the high rotational speed Vh. The controller 100 acquires the roll load Nh corresponding to the high rotational speed Vh in the same manner as when acquiring the roll load Nl corresponding to the low rotational speed Vl.

The controller 100 stores the acquired roll load Nl and the roll load Nh in the RAM 103 or the PROM 104, and terminates the load measuring operation.

Here, the above-described roll load N is not limited to being stable during feeding of the medium P, and may change. For example, the roll load N is changed in a case of a deviation of the roll body RP, a variation in specific gravity of the roll body RP in a circumferential direction, changing of a frictional force between the medium P and a feeding path, changing of a Young's modulus of the medium P, or the like. In a case of changing of the roll load N, when the output torque M is constant, the tension T is also changed (refer to FIG. 5B). In this case, the tension T is changed in every feeding operation. As a result, a feeding amount is changed in every feeding operation, and a defect, such as banding, is generated in an image recorded on the medium P. Here, the recording apparatus 10 calculates a corrected tension Tb obtained by correcting the target tension Ta by controlling a tension FB (feedback) to be described later, and calculates the output torque M using the calculated corrected tension Tb. In other words, the recording apparatus 10 corrects the target tension Ta so that the feeding amount in every feeding operation is constant.

Figure 7:
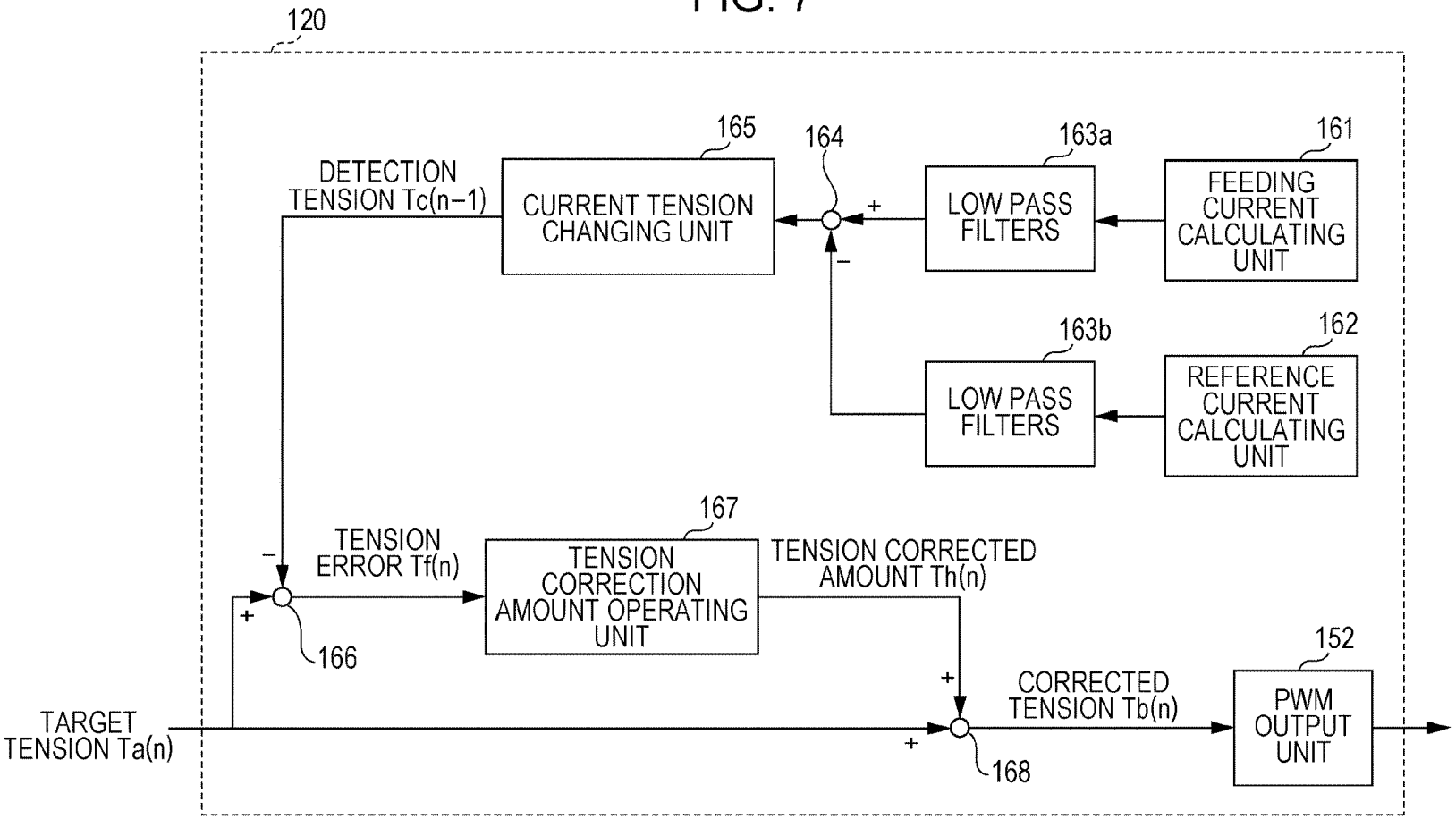
FIG. 7 is a block diagram illustrating a functional configuration example of a roll motor control unit.

FIG. 7 is a block diagram of the roll motor control unit 120 at the time of controlling the tension FB. The roll motor control unit 120 includes a feeding current calculating unit 161, a reference current calculating unit 162, low pass filters 163*a* and 163*b*, a current subtracting unit 164, a current-tension converting unit 165, a tension subtracting unit 166, a tension correction amount calculating unit 167, a tension adding unit 168, and a PWM output unit 152.

Moreover, a "detection tension acquiring unit" is configured to have the feeding current calculating unit 161, the reference current calculating unit 162, the current subtracting unit 164, and the current-tension converting unit 165 as main constituents. A "corrected tension calculating unit" is configured to have the tension subtracting unit 166, the tension correction amount calculating unit 167, and the tension adding unit 168 as main constituents.

The feeding current calculating unit 161, during the feeding operation, calculates a feeding current Ia(k) which is a current flowing in the feeding motor 53, at a predetermined calculation interval of, for example, 1 msec. Here, Ia(k) means a feeding current Ia which is calculated in a k-th calculation operation. The calculated feeding current Ia(k) is input to the current subtracting unit 164 through the low pass filter 163*a*.

In addition, the reference current calculating unit 162 calculates, at the time of the reference current measuring operation, a reference current Ib(k) which is a current flowing in the feeding motor 53 at the same calculating interval as that of the feeding current calculating unit 161 (in this case, of 1 msec). In the reference current measuring operation, the controller 100 drives the feeding motor 53 at the same rotational speed and the same driving time as when the feeding operation is performed in a state in which the medium P is loosened. The controller 100 executes the reference current measuring operation, for example, before starting each recording job. Moreover, it is preferable that the controller 100 performs the reference current measuring operation in every recording job multiple times, and the reference current calculating unit 162 takes an average value of the resultant as the reference current Ib(k). The controller 100 stores the calculated reference current Ib(k) in the RAM 103 or the PROM 104, and terminates the reference current measuring operation. The calculated reference current Ib(k) is input to the current subtracting unit 164 through the low pass filter 163*b*.

Here, a current I flowing in the feeding motor 53 can be calculated by Equation (7).

$$I=(E\times\text{Duty}-Ke\times\omega)/RR \tag{7}$$

E: power supply voltage.
Duty: PWM control value output to feeding motor 53.
Ke: back electromotive force constant of feeding motor 53.
ω: rotational speed of feeding motor 53.
RR: resistance of feeding motor 53.

Moreover, since the back electromotive force constant Ke and the resistance RR of the feeding motor 53 are changed by temperature, these may be corrected.

The current subtracting unit 164 calculates the tension current Ic(k) which is calculated by subtracting the reference current Ib(k) from the feeding current Ia(k). The current subtracting unit 164 calculates an average tension current Id which is an average value of a plurality of calculated tension currents Ic(k) and a peak tension current Ie which is a maximum value in the plurality of tension currents Ic(k). The calculated average tension current Id and the peak tension current Ie are input to the current-tension converting unit 165.

The current-tension converting unit 165 calculates the average tension Td based on the average tension current Id, and calculates the peak tension Te based on the peak tension current Ie. The average tension Td and the peak tension Te can be respectively calculated by Equation (8) and Equation (9).

$$Td=Id\times Kt\times Z/Rk \tag{8}$$

$$Te=Ie\times Kt\times Z/Rk \tag{9}$$

Kt: torque constant of feeding motor 53.
Z: speed reduction ratio of feeding motor 53.
Rk: radius of driving roller 51*a*.

Further, the current-tension converting unit 165 calculates a detection tension Tc by Equation (10).

$$Tc=\{Q1\times Td/(Q1+Q2)\}+\{Q2\times Te/(Q1+Q2)\} \tag{10}$$

Here, Q1 and Q2 are arbitrary integers for weighting of the average tension Td and the peak tension Te with respect to the detection tension Tc. Values of Q1 and Q2 will be set in terms of a degree of a correlation between the feeding amount and the detection tension TC calculated from the tension current Ic(k) which is complexly changed during one feeding operation is calculated. Since a waveform of the tension current Ic(k) is changed by, for example, the feeding speed of the medium P, the feeding amount of the medium P in each feeding operation, the diameter of the roll body RP, or the like, it is preferable that multiple sets of the values of Q1 and Q2 are prepared according to these changes. In addition, either or both of the values of Q1 and Q2 may be 0. That is, the detection tension Tc may be the same as the average tension Td, and the detection tension Tc may be the same as the peak tension Te. For example, in a case in which the feeding amount of the medium P in each feeding operation is relatively small, the peak tension Te greatly influences the feeding amount, and therefore, the detection tension Tc may be obtained based on only the peak tension Te by setting Q1 as zero. In addition, in a case in which the feeding speed of the medium P is fast, a difference between the average tension Td and the peak tension Te may be changed by a size of the diameter of the roll body RP, specific gravity of the medium P, or the like, and thus, it is preferable that the values of Q1 and Q2 are set, and the detection tension Tc is obtained using both the average tension Td and the peak tension Te. At the time of using both the average tension Td and the peak tension Te, the values of Q1 and Q2 are adjusted in response to a changed amount of the difference between the average tension Td and the peak tension Te, weights of the average tension Td and the peak tension Te can be changed. Moreover, in a case in which the difference between the average tension Td and the peak tension Te is stable without changing, the detection tension Tc may be obtained by using only the average tension Td by setting Q2 as zero.

The tension subtracting unit 166 calculates a tension error Tf(n) of the detection tension Tc(n−1) output from the current-tension converting unit 165 and the target tension Ta(n) instructed by the main control unit 110.

Moreover, each value in the parentheses means the ordinal number of the feeding operation. For example, Ta(n) means the target tension Ta at the time of an n-th feeding operation. This also applies to the following description.

The tension correction amount calculating unit 167 calculates a tension error integral value Tg(n) obtained by integrating the tension errors Tf(n) output from the tension subtracting unit 166 by Equation (11). Further, the tension correction amount calculating unit 167 calculates the tension correction amount Th(n) by Equation (12).

$$Tg(n)=Tg(n-1)+Tf(n) \tag{11}$$

$$Th(n)=Tg(n)\times G \tag{12}$$

Here, G indicates a gain.

Moreover, the tension error integral value Tg is initialized, that is, is cleared to be zero in response to any one of mounting of the roll body RP, changing of the target tension Ta, and changing of the feeding speed of the medium P as a trigger.

The tension adding unit 168 adds the target tension Ta(n) instructed by the main control unit 110 to the tension correction amount Th(n) output from the tension correction amount calculating unit 167, and outputs the total corrected tension Tb(n) to the PWM output unit 152.

The PWM output unit 152 calculates the output torque M of the roll motor 33 by substituting the corrected tension Tb(n) which is output from the tension adding unit 168 into above-described Equation (6). The PWM output unit 152 outputs the PWM signal of a duty value proportional to the output torque M to the motor driver 106. The motor driver 106 drives the feeding motor 53 by PWM-control based on the PWM signal output from the PWM output unit 152. Accordingly, the roll motor control unit 120 can perform control for realizing the corrected tension Tb(n).

As described above, according to the recording apparatus 10 of the embodiment, by feeding back the detection tension Tc(n−1) during the (n−1)-th feeding operation to the n-th feeding operation, the corrected tension Tb(n) obtained by correcting the target tension Ta(n) is calculated, and the roll motor 33 is controlled during the n-th feeding operation based on the calculated corrected tension Tb(n). For this reason, during the n-th feeding operation, an error in an actual tension T with respect to the target tension Ta(n) can be reduced. As a result, even in a case in which the roll load N is changed during feeding of the medium P due to the deviation of the roll body RP, changing of the tension T which is applied to the medium P in every feeding operations can be suppressed.

In addition, according to the recording apparatus 10 of the embodiment, since the apparatus has a configuration in which the detection tension Tc detected during the (n−1)-th feeding operation is fed back to the n-th feeding operation, in each feeding operation, the target tension Ta is corrected based on the detection tension Tc during the previous feeding operation. Accordingly, the error in the actual tension T with respect to the target tension Ta can be further reduced. Moreover, after mounting the roll body RP, in a first feeding operation, the target tension Ta (1) cannot be corrected by controlling the tension FB of the embodiment. However, the tension error Tf (1) during the first feeding operation can be reduced as much as possible by performing the above-described load measuring operation.

In addition, according to the recording apparatus 10 of the embodiment, the feeding current Ia and the reference current Ib flowing in the roll motor 33 are acquired so that the detection tension Tc can be calculated.

In addition, according to the recording apparatus 10 of the embodiment, based on at least one of the average tension Td corresponding to the average tension current Id and the peak tension Te corresponding to the peak tension current Ie, the detection tension Tc is calculated. Accordingly, the detection tension Tc correlated with the feeding amount can be calculated from the tension current Ic which is complexly changed during one feeding operation.

In addition, according to the recording apparatus 10 of the embodiment, the tension correction amount Th is calculated by using the tension error integral value Tg, that is, an integral controlling is performed, thereby making it possible for the actual tension to be gradually approximated to the target tension Ta. For this reason, even when the detected error is included in the detection tension Tc, calculating the tension correction amount Th in a state in which the detected error amplified can be suppressed.

Moreover, the embodiment can be changed as follows.

The detection tension Tc which is fed back during the n-th feeding operation may be the detection tension Tc during an arbitrary feeding operation in the (n−1)-th and earlier feeding operations, for example, may be the detection tension Tc(n−2) during the (n−2)-th feeding operation. In this case, the tension subtracting unit 166 calculates the tension error Tf(n) as an error between the detection tension Tc(n−2) and the target tension Ta(n). Preferably, at the time of rotating the roll body RP during the feeding operation, the detection tension Tc during an operation at an angle which is the same as an angle of the roll body RP during one rotation may be used. That is, in a case in which the rotational speed, or the like is changed during one rotation of the roll body RP, the detection tension Tc during an operation at an angle in which changing of the rotation speed is generated by the same amount during the feeding operation may be used. Accordingly, in a case in which the roll body RP is eccentric, the detection tension Tc during the feeding operation in a state in which load changing at the time of rotating the roll body RP is approximated can be used. In addition, the detection tension Tc which is fed back during the n-th feeding operation may be an average value of all operations of the (n−1)-th and earlier operations, or of plural arbitrary operations before the n-th feeding operation.

For acquiring the detection tension Tc, for example, a tension measuring device may be installed between the roll body RP and the driving roller 51*a*, and a tension T of the medium P measured by the tension measuring device may be acquired as the detection tension Tc.

An application example of the medium feeding apparatus of the invention is not limited to the recording apparatus in an ink jet type, and for example, the medium feeding apparatus may be a dot impact recording apparatus or an electrophotographic recording apparatus. Further, the medium feeding apparatus is not limited to the recording apparatus, and for example, the medium feeding apparatus of the invention may be applied to the a drying apparatus which performs a drying process on the medium while feeding the medium and a surface process apparatus which performs a surface process on the medium while feeding the medium. In addition, the medium feeding apparatus is not limited to an apparatus which performs such processes on the medium, and may be an apparatus which only feeds the medium.

The entire disclosure of Japanese Patent Application No. 2014-102059, filed May 16, 2014 and 2015-063900, filed Mar. 26, 2015 are expressly incorporated by reference herein.

What is claimed is:

1. A medium feeding control method of a medium feeding apparatus which includes a holding unit that holds a roll body around which a medium is wound, a feeding unit that pulls and feeds the medium from the roll body, and a rotation driving unit that rotates the roll body through the holding unit in a direction in which the medium is fed from the roll body, and a feeding driving unit that drives the feeding unit, and performs a feeding operation multiple times in which the medium is fed, the method comprising:

acquiring a detection tension corresponding to a tension applied to the medium between the roll body and the feeding unit during an n−1 or earlier feeding operation, where n is an integer equal to or greater than 2, in an n number of the feeding operations;

calculating a corrected tension by correcting a target tension which is a target value of a tension to be applied during an n feeding operation occurring after the n−1 feeding operation on the basis of the detection tension; and controlling the feeding driving unit during the n feeding operation based on the corrected tension, wherein when acquiring the detection tension, a feeding current flowing in the feeding driving unit during the n−1 or earlier feeding operation and a reference current flowing in the feeding driving unit in a state in which the medium between the roll body and the feeding driving unit is loosened at the time of performing a reference current measuring operation for measuring the reference current that drives the feeding driving unit are acquired, a tension current which is a difference between the feeding current and the reference current is calculated, and the detection tension is calculated based on the tension current.

2. The medium feeding control method according to claim 1, wherein the feeding current is acquired multiple times at a predetermined interval in one feeding operation when acquiring the feeding current, wherein the reference current is acquired multiple times at the predetermined interval in one reference current measuring operation when acquiring the reference current, wherein a plurality of the tension currents is acquired from the feeding currents acquired at the predetermined interval and the reference currents acquired at the predetermined interval when calculating the tension current, respectively, and wherein the detection current is acquired on the basis of an average tension current which is an average value of the plurality of tension currents when acquiring the detection tension.

3. The medium feeding control method according to claim 1, wherein the feeding current is acquired multiple times at a predetermined interval in one feeding operation when acquiring the feeding current, wherein the reference current is acquired multiple times at the predetermined interval in one reference current measuring operation when acquiring the reference current, wherein a plurality of the tension currents is acquired from the feeding currents acquired at the predetermined interval and the reference currents acquired at the predetermined interval when calculating the tension current, respectively, and wherein the detection current is acquired on the basis of a peak tension current which is a maximum value in the plurality of tension currents when acquiring the detection tension.

4. The medium feeding control method according to claim 1, wherein the detection tension corresponding to the tension applied to the medium during the (n−1) n−1 feeding operation is acquired, when acquiring the detection tension.

5. The medium feeding control method according to claim 1, wherein when calculating the corrected tension, a tension error integral value obtained by integrating the tension errors which are errors in the detection tensions with respect to the target tension is calculated, a tension correction amount is calculated on the basis of the tension error integral value, and the corrected tension is calculated by adding the tension correction amount to the target tension.

6. A medium feeding apparatus comprising:

a holding unit that holds a roll body around which a medium is wound;

a feeding unit that pulls and feeds the medium from the roll body;

a rotation driving unit that rotates the roll body through the holding unit so that the medium is fed from the roll body;

a feeding driving unit that drives the feeding unit;

a detection tension acquiring unit that acquires a detection tension which is a tension applied to the medium between the roll body and the feeding unit during an n−1 or earlier feeding operation, where n is an integer equal to or greater than 2, in an n number of feeding operations in which the medium is fed;

a corrected tension calculating unit that calculates a corrected tension obtained by correcting a target tension which is a target value of a tension to be applied during an n feeding operation occurring after the n−1 feeding operation based on the detection tension; and a driving controlling unit that controls the feeding driving unit during the n feeding operation based on the corrected tension, wherein when acquiring the detection tension, a feeding current flowing in the feeding driving unit during the n−1 or earlier feeding operation and a reference current flowing in the feeding driving unit in a state in which the medium between the roll body and the feeding driving unit is loosened at the time of performing a reference current measuring operation for measuring the reference current that drives the feeding driving unit are acquired, a tension current which is a difference between the feeding current and the reference current is calculated, and the detection tension is calculated based on the tension current.

* * * * *